US009930924B2

(12) United States Patent
Threlfall

(10) Patent No.: US 9,930,924 B2
(45) Date of Patent: Apr. 3, 2018

(54) EXTRACTION PLATFORM

(71) Applicant: Shane David Threlfall, Dapto (AU)

(72) Inventor: Shane David Threlfall, Dapto (AU)

( * ) Notice: Subject to any disclaimer, the term of this patent is extended or adjusted under 35 U.S.C. 154(b) by 433 days.

(21) Appl. No.: 14/569,604

(22) Filed: Dec. 12, 2014

(65) Prior Publication Data

US 2015/0164182 A1 Jun. 18, 2015

(30) Foreign Application Priority Data

Dec. 13, 2013 (AU) ..... 2013904865

(51) Int. Cl.

| | |
|---|---|
| ***A43C 15/02*** | (2006.01) |
| ***A43B 3/16*** | (2006.01) |
| ***A43B 3/00*** | (2006.01) |
| *A43B 5/18* | (2006.01) |

(52) U.S. Cl.

CPC ..... *A43B 3/0026* (2013.01); *A43B 3/00* (2013.01); *A43B 3/16* (2013.01); *A43B 5/18* (2013.01); *Y10T 137/6633* (2015.04)

(58) Field of Classification Search

CPC ..... A43B 3/16; A43B 3/0026; A43C 19/00
See application file for complete search history.

(56) References Cited

U.S. PATENT DOCUMENTS 683,595 A 10/1901 Drouillard
1,266,492 A * 5/1918 Helms et al. ..... A43B 5/18 36/116
2,367,219 A * 1/1945 Kearny ..... A43B 3/0026 36/116
2,412,474 A * 12/1946 Scott-Paine ..... B63B 35/811 114/291
4,447,969 A * 5/1984 Johnson ..... A43B 3/0026 36/116
4,525,941 A * 7/1985 Ruth, Jr. ..... A43B 5/18 36/116
5,375,345 A * 12/1994 Djuric ..... A43B 3/00 36/3 B
2005/0183290 A1* 8/2005 Cantrell ..... A43B 3/0026 36/116
2006/0059722 A1* 3/2006 Jarriel ..... A43B 3/00 36/116

* cited by examiner

*Primary Examiner* — Jila M Mohandesi
(74) *Attorney, Agent, or Firm* — Ariel S. Bentolila; Bay Area IP Group, LLC

(57) ABSTRACT

An extraction platform helps disengage a load from a pliant surface by pumping a portion of the pliant surface out from beneath the platform. By forcibly removing portions of the pliant surface, i.e., debris, mud, snow, from beneath the platform housing, any seals, vacuums, tensile forces, or adhesive constituents are broken or disturbed sufficiently, such that the platform housing and the load disengage from the pliant surface. The platform also provides a large surface area for spreading out the weight of the load. The platform includes a mounting surface that joins with the load. A traction surface engages the pliant surface. A pump portion pumps portions of the pliant surface into an intake aperture, and out through a discharge aperture. A drive portion having sprockets and a cable drives the pump portion through momentum forces created by the platform housing, such as articulations of a walking gait.

19 Claims, 5 Drawing Sheets

EXTRACTION PLATFORM

CROSS-REFERENCE TO RELATED APPLICATIONS

The present Utility patent application claims priority benefit of the Australian Provisional patent application 2013904865 entitled "Apparatus for Improving Personal Mobility on Soft Surfaces" filed on 13 Dec. 2013 under 35 U.S.C. 119(a).

RELATED CO-PENDING U.S. PATENT APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

FIELD OF THE INVENTION

One or more embodiments of the invention generally relate to an extraction platform. More particularly, the invention relates to an extraction platform that helps disengage a load from a pliant surface by pumping a portion of the pliant surface from beneath the platform and providing a large surface area to distribute the weight of the load.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that a snowshoe is footwear for walking over the snow. Snowshoes or mud boots work by distributing the weight of the person over a larger area so that the foot does not sink completely into the snow.

It is known that wearing waders, boot, or hip-boots, areas are often traversed in which the bottom or soil is composed mostly of mud or other thixotropic medium. The mud can make walking very difficult, because with each step the boot sinks into the mud and then, because of the cohesive and/or adhesive properties of mud, it is very difficult to remove the boot from the mod.

In many instances, the boot may still penetrate the mud, particularly if the wearer stands still in one place for any length of time, such as when hunting or fishing. Then, extraction becomes more difficult because the increased surface area requires even more effort to extract the boot from the mud. In addition, the larger area makes walking more awkward, as do snowshoes.

Typically, a pump is a device that moves fluids, such as liquids, gases, or sometimes slurries, by mechanical action. The pump can help remove many of the same surfaces that a mud boot or snow shoe sinks into, and then becomes cohesively attached thereto.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
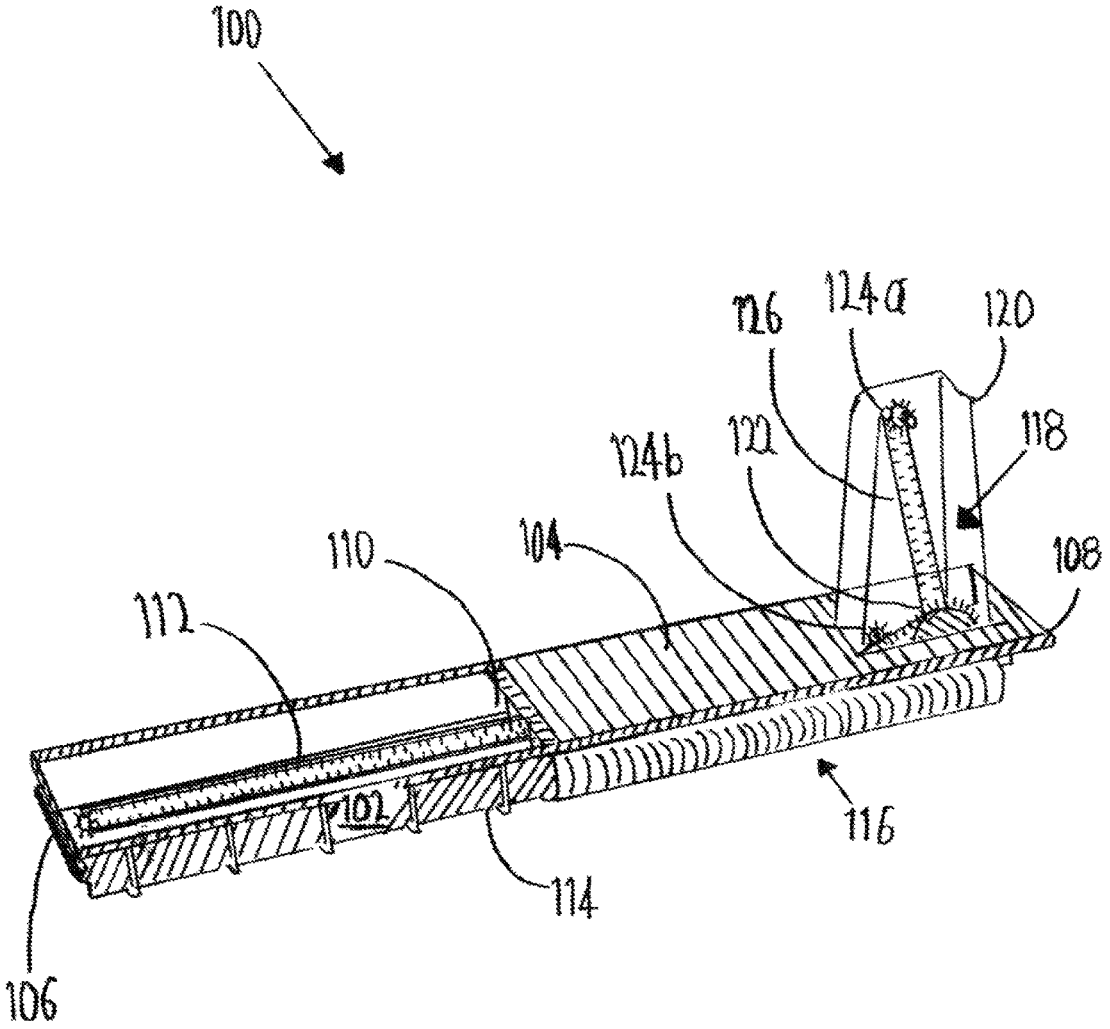
FIG. 1 illustrates a perspective upper view of an exemplary extraction platform, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, is well settle law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, term 'substantially' is well recognize in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003)" Id. at 1311. Similarly, the plain language of claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hoffinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. § 112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to 'avoid a strict numerical boundary to the specified parameter, see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" includes the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, is generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of or interaction, with some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising." This term is open-ended. As used in the appended claims, this term does not foreclose additional structure or steps. Consider a claim that recites: "A memory controller comprising a system cache . . . ." Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. sctn. 112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" limits the scope of a claim to the specified elements or method steps, plus those that do not materially affect the basis and novel characteristic(s) of the claimed subject matter.

With respect to the terms "comprising," "consisting of," and "consisting essentially of," where one of these three terms is used herein, the presently disclosed and claimed subject matter may include the use of either of the other two terms. Thus in some embodiments not otherwise explicitly recited, any instance of "comprising" may be replaced by "consisting of" or, alternatively, by "consisting essentially of."

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

The present invention will now be described in detail with reference to embodiments thereof as illustrated in the accompanying drawings.

There are various types of extraction platforms for enhancing stabilization and helping to disengage the platforms from a pliant surface that may be provided by preferred embodiments of the present invention. In one embodiment of the present invention, an extraction platform may help stabilize and disengage a load from a pliant surface by pumping a portion of the pliant surface out from beneath the platform. The platform may also provide a large surface area for spreading out the weight of the load on the platform. The platform may include a mounting surface that joins with the load.

The load may include, without limitation, a foot, a boot, a shoe, and a snow track. The load may fasten to, and articulate in unison with a platform housing. In one embodiment, the platform housing is operational in a walking gait articulation. In some embodiments, the pliant surface may include, without limitation, mud, silt, snow, and soft clay. Those skilled in the art will recognize that these types of pliant surfaces may form a seal with the platform, a shoe, or any other type of flat surface used for walking. Consequently, the seal may create a vacuum that partially restricts disengagement between the platform and the pliant surface.

The platform housing may be defined by a front end and a rear end. The platform housing may also be defined by a mounting surface for joining with the load, and a traction surface for engaging with the pliant surface. In one embodiment, the platform housing propels forwards towards the front end in a natural walking and/or running gait. The front end articulates in a coordinated movement with the rear end of the platform, whereby each end independently and jointly engages and disengages the pliant surface to move in multiple directions.

In one embodiment the walking gait comprises a first articulation of the rear end of the platform housing engaging the pliable surface while the front end of the platform housing orients upwardly while disengaged from the platform. A second articulation involves both the front end and the rear end fully engaging the pliant surface. It is significant to note that the second articulation is where the platform housing may have the greatest resistance to disengaging form the pliant surface as a vacuum forms between the pliant surface and the traction surface of the platform housing.

A third articulation may include the front end of the platform housing engaging the pliant surface while the rear end of the platform disengages from the platform. In the third gate, the front end serves as a lever to help propel the platform housing forward and subsequently, to disengage the platform from the pliant surface. A fourth articulation involves both the front end and the rear end fully disengaged from the plaint surface. Additionally, the stabilization and disengagement of the platform housing from the pliant surface may be enhanced by leveraging the pendulum dynamics of the walking gait and the ground reaction forces generated during the walking gait.

In some embodiments, the platform housing may include a traction surface that engages the pliant surface. The traction surface may include at least one intake aperture for receiving a portion of the pliant surface, such as mud debris from a soft ground surface. The traction surface may further include at least one discharge aperture in communication with the intake aperture. The discharge aperture is configured to discharge the portion of the pliable surface propelled into the intake aperture.

A discharge channel may extend between the intake aperture and the discharge aperture. The discharge channel serves to carry the portion of the pliable surface. In some embodiments, at least one ridge may form around multiple intake apertures. The ridge may help funnel the portion of the pliant surface into the intake aperture. Additionally, the traction surface may help disengage the platform from the pliant surface by forming a large surface area that spreads the weight of the load on the pliant surface.

In some embodiments, the portion of the pliant surface may be propelled into the intake aperture with a pump portion. The pump portion may be disposed to extend along the length of the platform housing and within an interior region of the platform housing. The pump portion serves to create a vacuum that sucks the portion of the pliant surface into the intake aperture, through the discharge chamber, and finally out the discharge aperture. In one embodiment, the pump portion may include a piston contained in the discharge channel.

The piston may laterally reciprocate in coordination with the articulation of the platform housing to propel portions of the pliant surface through the intake aperture. In one embodiment, the piston may reciprocate in a linear motion between the front and rear ends of the platform housing. The linear displacement of the piston towards the rear end forms a vacuum in the discharge channel that may be sufficient to suck in portions of the pliant surface through the intake aperture.

In some embodiments, the piston may be actuated when the platform is in the first, second, or third articulation of the walking gait. Consequently, portions of the pliant surface pass through the discharge channel towards the rear end before exiting from the discharge aperture. In some embodiments, the forced extrusion of portions of pliant surface from between the traction surface and the pliant surface may facilitate disengagement of the platform from the pliant surface. This is because the seal that forms between the traction surface and the pliant surface is agitated and thus may break. The piston may return to the forward end for another cycle after the discharge is complete.

In some embodiments, the reciprocating action of the piston may be powered by momentum forces created by the articulation of the platform housing and centrifugal forces created between the articulations from the walking gait. In this manner, a power source, such as a battery may not be needed for operation of the piston. In one embodiment, a drive portion actuates the piston in the lateral reciprocating movement along the discharge channel. The drive portion is actuated by the momentum of the walking gait and movement of the platform housing. In one embodiment, the drive portion may include a series of sprockets, chains, and drive trains that work in coordination with the piston.

In some embodiments, the drive portion may be disposed towards the rear end of the platform housing, protruding out from the mounting surface. A drive housing may cover the drive portion. A cable may rotate around a main sprocket and at least one secondary sprocket. The cable may be in communication with the piston. The rotary motion of the cable on the sprockets is configured to convert to the linear motion of the piston through a linear actuator. In some embodiment, the faster the walking gait, such as in a running gait, the faster the piston pumps the portion of the pliant surface through the discharge channel.

FIG. 1 illustrates a perspective upper view of an exemplary extraction platform, in accordance with an embodiment of the present invention. In one aspect, an extraction platform 100 may help stabilize a load, and disengage the load from a pliant surface by pumping a portion of the pliant surface out from beneath a platform housing 102. Thus, by forcibly discharging portions of the pliant surface, i.e., debris, mud, snow, from beneath the platform housing, any formed seals, vacuums, tensile forces, or adhesive constituents between the platform housing and the pliant surface are broken or disturbed sufficiently, such that the platform housing and the attached load may disengage from the pliant surface. Additionally, the platform housing may provide a large surface area for spreading out the weight of the load on the platform for enhanced stability.

In some embodiments, the platform may include a mounting surface. The mounting surface may be configured to receive the load. The mounting surface may join with the load at a load fastening portion 110. The load fastening portion may include a barrier that rests perpendicularly to the mounting surface for at least partially restricting movement of the load. Other forms of load fastening portions may include, without limitation, straps, bolts, adhesives, magnets, and welding. In any case, the load mounting surface may include various fastening mechanisms that mate with the load to form a substantially unitary component with the load, such that movement of the load articulates with the platform housing. In one embodiment, the mounting surface comprises a gritted texture for firmly holding a boot.

The load may include, without limitation, a foot, a boot, a shoe, and a snow track. The load may fasten to, and articulate in unison with the platform housing. In one embodiment, the platform housing is operational in a walking gait articulation. In some embodiments, the pliant surface may include, without limitation, mud, silt, snow, and soft clay. Those skilled in the art will recognize that these types of pliant surfaces may form a seal with the platform, a shoe, or any other type of flat surface used for walking. Consequently, the seal may create a vacuum that partially restricts disengagement between the platform housing and the pliant surface.

The platform housing may be defined by a front end 106 and a rear end 108. The platform housing may also be defined by a mounting surface 104 for joining with the load, and a traction surface for engaging with the pliant surface. In one embodiment, the platform housing propels forwards towards the front end in a natural walking and/or running gait. The front end articulates in a coordinated movement with the rear end of the platform housing, whereby each end independently and jointly engages and disengages the pliant surface to move in multiple directions.

In some embodiments, the platform housing may include a traction surface 114 that engages the pliant surface. The traction surface may include at least one intake aperture for receiving a portion of the pliant surface, such as mud debris from a soft ground surface. The traction surface may further include at least one discharge aperture in communication with the intake aperture. The discharge aperture is configured to discharge the portion of the pliable surface propelled into the intake aperture.

A discharge channel 112 may extend between the intake aperture and the discharge aperture. The discharge channel serves to carry the portion of the pliable surface. In some embodiments, at least one ridge may form around multiple intake apertures. The ridge may help funnel the portion of the pliant surface into the intake aperture. Additionally, the traction surface may help disengage the platform housing from the pliant surface by forming a large surface area that spreads the weight of the load on the pliant surface.

In some embodiments, the portion of the pliant surface may be propelled into the intake aperture with a pump portion 116. The pump portion may be disposed to extend along the length of the platform and within an interior region of the platform housing. The pump portion serves to create a vacuum that sucks the portion of the pliant surface into the intake aperture, through the discharge chamber, and finally out the discharge aperture. In one embodiment, the pump portion may include a piston contained in the discharge channel.

The piston may laterally reciprocate in coordination with the articulation of the platform to propel portions of the pliant surface through the intake aperture. In one embodiment, the piston may reciprocate in a linear motion between the front and rear ends of the platform. The linear displacement of the piston towards the rear end forms a vacuum in the discharge channel that may be sufficient to suck in portions of the pliant surface through the intake aperture.

In some embodiments, the piston may be actuated when the platform housing is in the first, second, or third articulation of the walking gait. Consequently, portions of the pliant surface pass through the discharge channel towards the rear end before exiting from the discharge aperture. In some embodiments, the forced extrusion of portions of pliant surface from between the traction surface and the pliant surface may facilitate disengagement of the platform housing from the pliant surface. This is because the seal that forms between the traction surface and the pliant surface is agitated and thus may break. The piston may return to the forward end for another cycle after the discharge is complete.

In some embodiments, a drive portion 118 may actuate the pump portion by generating a rotary motion from momentum forces generated during movement of the load (walking gait), to a linear reciprocating motion by the piston. The drive portion may be disposed towards the rear end of the platform housing, protruding out from the mounting surface. A drive housing 120 may cover the drive portion. A cable 126 may rotate around a main sprocket 122 and at least one secondary sprocket 124*a*, 124*b*, 124*c*. The cable may include a chain. The cable may be in communication with the piston. The rotary motion of the cable on the sprockets is configured to convert to the linear motion of the piston through a linear actuator. In some embodiment, the faster the walking gait, such as in a running gait, the faster the piston pumps the portion of the pliant surface through the discharge channel.

Figure 2:
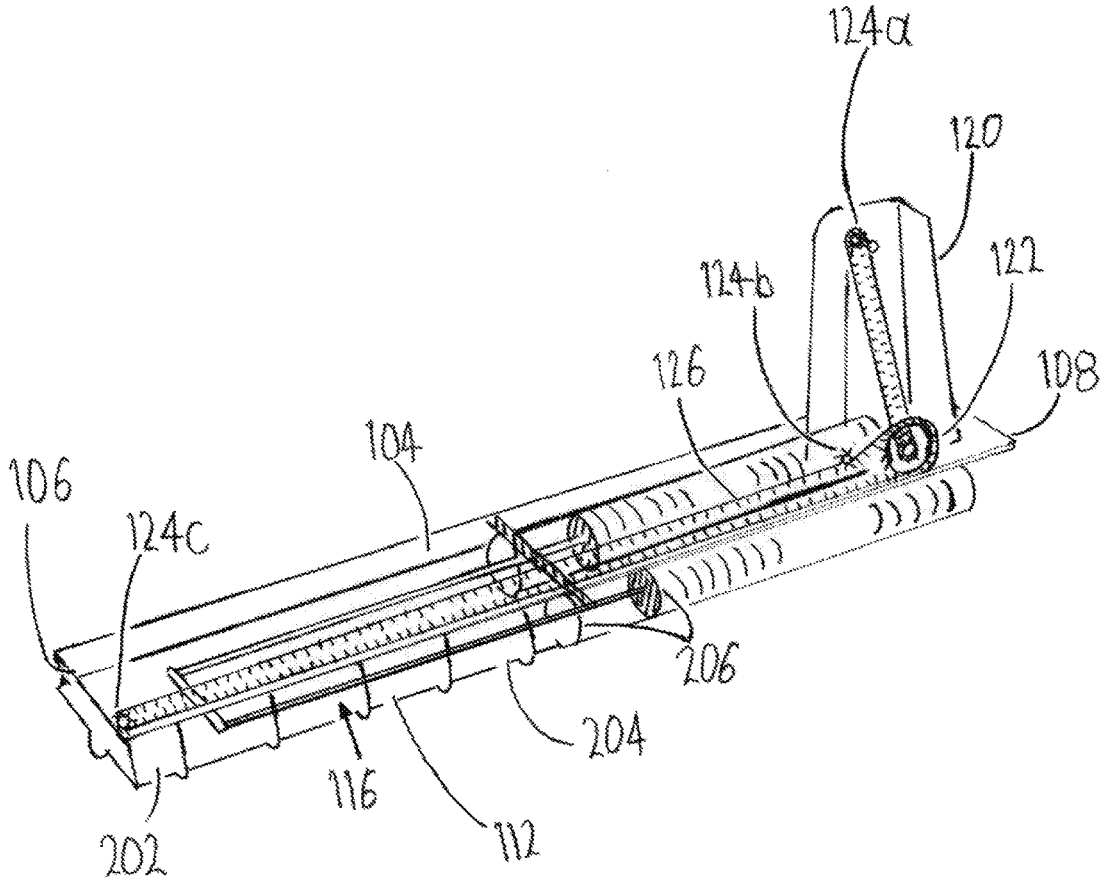
FIG. 2 illustrates a sectioned upper view of an exemplary extraction platform, in accordance with an embodiment of the present invention.

FIG. 2 illustrates a sectioned upper view of an exemplary extraction platform, in accordance with an embodiment of the present invention. In one aspect, the reciprocating action of a piston 206 in the pump portion may be powered by momentum forces created by the articulation of the platform housing and centrifugal and momentum forces created between the articulations of the load in the walking gait. In this manner, a power source, such as a battery may not be needed for operation of the piston, or any part of the pump portion. The piston may suck in portions of the pliant surface through an intake aperture 202, and then discharge the portions through a discharge aperture 204. The apertures may include, without limitations, a slot, a round hole, a crevice, and a grill. In one embodiment, a drive portion actuates the piston in the lateral reciprocating movement along the discharge channel. The drive portion is actuated by the momentum of the walking gait and movement of the platform housing. In one embodiment, the drive portion may include a series of sprockets, chains, and drive trains that work in coordination with the piston.

Figure 3:
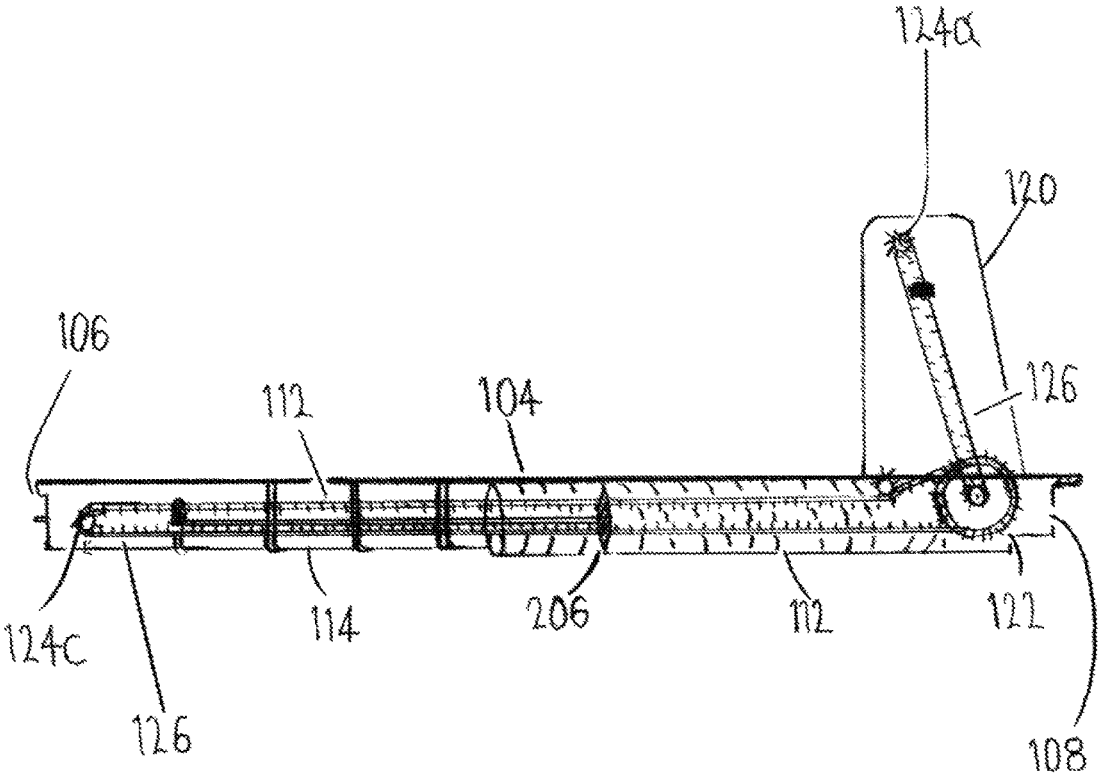
FIG. 3 illustrates a sectioned side view of an exemplary extraction platform, in accordance with an embodiment of the present invention.

FIG. 3 illustrates a sectioned side view of an exemplary extraction platform, in accordance with an embodiment of the present invention. In one aspect, the piston may move towards the rear end of the platform housing to generate the vacuum. The piston may reciprocate forward, towards the front end of the platform housing to continue the pumping cycle. In one embodiment, a pair of pistons work in conjunction to create suction through the at least one intake aperture. The pump portion may use hydraulics or simple mechanical contraptions that respond to momentum forces by the load and the platform housing. The piston may be adjusted to increase or decrease in reciprocating movement in relation to the movement by the housing platform. For example, without limitation, the platform housing may articulate 4", while the piston moves about 12".

Figure 4:
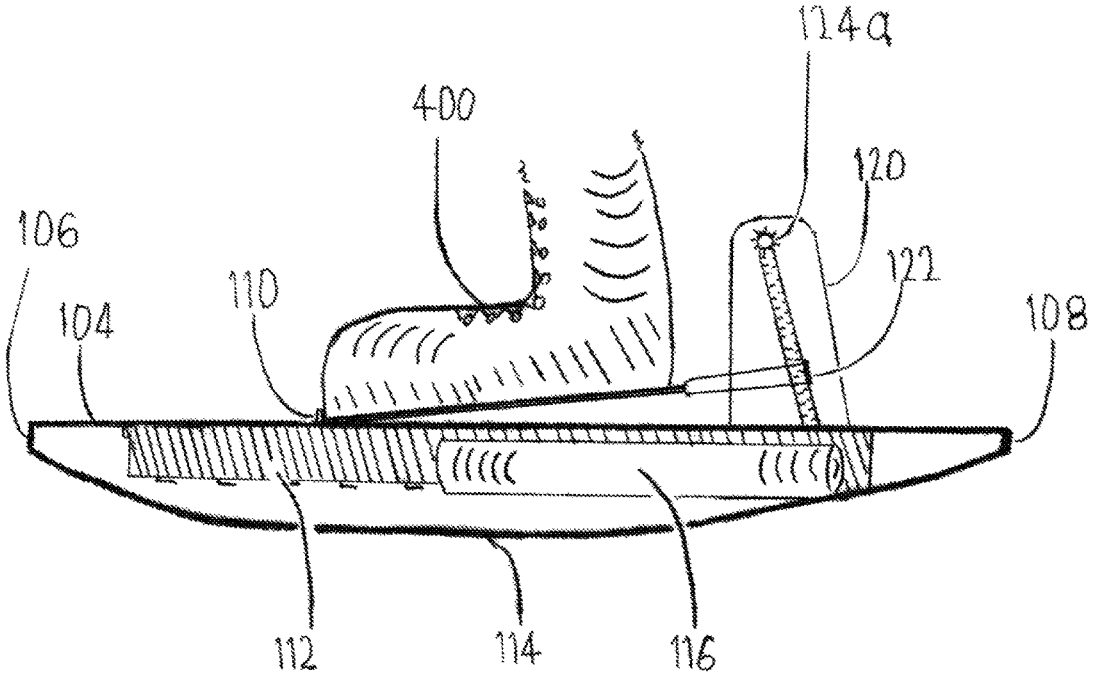
FIG. 4 illustrates a sectioned side view of an exemplary extraction platform joined with an exemplary load, in accordance with an embodiment of the present invention.

FIG. 4 illustrates a sectioned side view of an exemplary extraction platform joined with an exemplary load, in accordance with an embodiment of the present invention. In one aspect, the platform may be used to detachable join and carry a load 400 that is moving in a generally walking gait. The load may include, without limitation, a boot, shoe, or foot. The load may attach to the mounting surface through a load fastening portion. The load fastening portion may include a barrier disposed perpendicularly to the mounting surface. In one embodiment, the load fastening portion may include a hook or ring that attaches to a front fastening mechanism on a boot. The propulsion of the load in a substantially walking gait provides the power needed to operate the In one embodiment the walking gait comprises a first articulation of the rear end of the platform engaging the pliable surface while the front end of the platform orients upwardly while disengaged from the platform. A second articulation involves both the front end and the rear end fully engaging the pliant surface. It is significant to note that the second articulation is where the platform may have the greatest resistance to disengaging form the pliant surface as a vacuum forms between the pliant surface and the traction surface of the platform.

A third articulation may include the front end of the platform engaging the pliant surface while the rear end of the platform disengages from the platform. In the third gate, the front end serves as a lever to help propel the platform forward and subsequently, to disengage the platform from the pliant surface. A fourth articulation involves both the front end and the rear end fully disengaged from the plaint surface. Additionally, the stabilization and disengagement of the platform from the pliant surface may be enhanced by leveraging the pendulum dynamics of the walking gait and the ground reaction forces generated during the walking gait.

In one embodiment, a pair of dual cylindrical pumps draw in material as a foot is pressed against the pliant surface, and exhales said material as the foot is being lifted in the process of the natural gait of walking. It is this process that allows easy foot extraction from the soft material. The dual cylindrical pumps design may incorporate sufficient exhaust material to enable the foot and apparatus extraction coupled with sufficient surface area of the platform housing to prevent excessive sinking into the pliant surface in the first place. The dual cylindrical pumps may inhale far greater material than the foot movement that takes place in walking due to the gearing of the sprockets. The gearing is novel in that it ensures the pump actuators move proportional greater distance than the foot movement. Dependent upon the constitution of the soft material sufficient an adjustable valve system can be used to maximise foot extraction capability.

Figure 5:
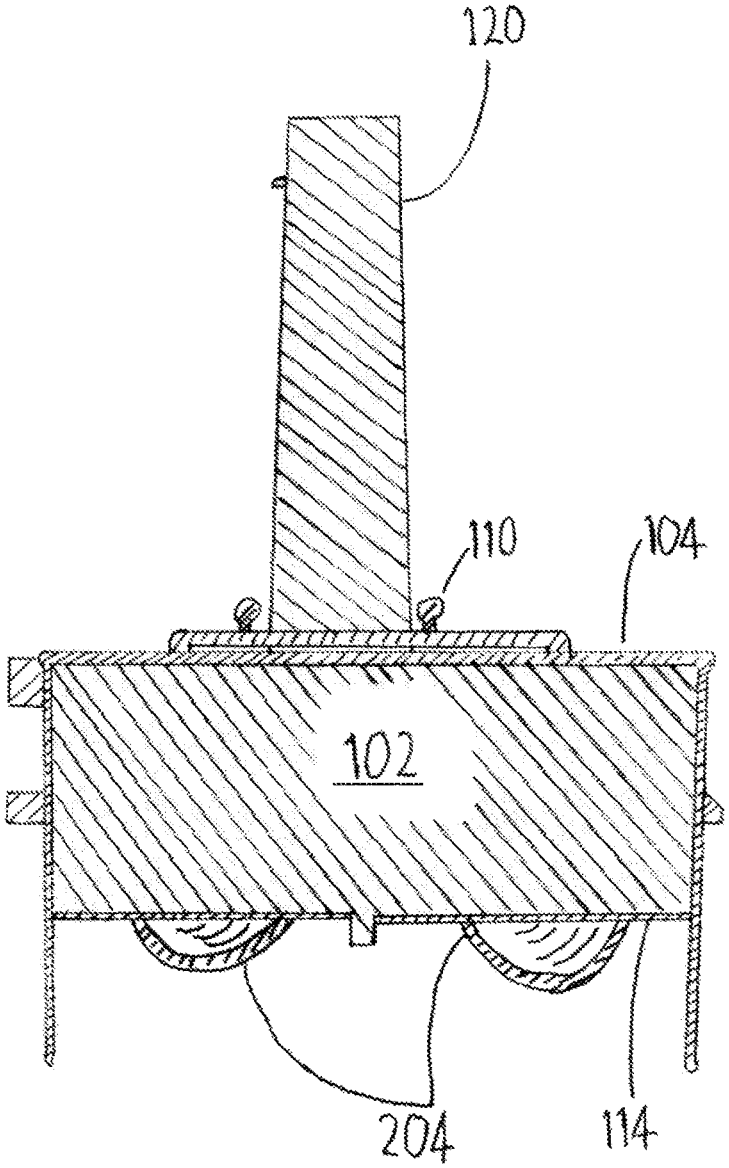
FIG. 5 illustrates a front view of an exemplary extraction platform, in accordance with an embodiment of the present invention.

FIG. 5 illustrates a front view of an exemplary extraction platform, in accordance with an embodiment of the present invention. In one aspect, the load, which may include a boot or a foot integrates with the platform housing to form a substantially unitary component. In many practical applications, the capacity of the extraction platform to discharge portions of the pliant surface, i.e., debris, helps disengage the platform housing and may help provide a foot operated pump that breaks the tension between mud and the platform housing and the attached load. The extraction platform may also help prevent clogging within the pump portion due to external forces being applied by the weight of the load while pushing down with the load in the process of walking. This may negate blockages and ensures tension is removed between the platform housing and the pliant surface. Furthermore, the platform extension may provide a pumping action that is foot operated, but still pumping. For example, the platform extension may offer effective tension removal within mud and similar material, for walking in compared to gravity alone systems, valve controlled or not.

In one alternative embodiment, the pump portion may be powered by a battery or an external power source. In another alternative embodiment, the capacity to displace portions of pliant material form the surface may be used on tracks for a snowmobile or skis. In yet another alternative embodiment, the drive portion may be powered through hydraulics.

Those skilled in the art will readily recognize, in light of and in accordance with the teachings of the present invention, that any of the foregoing steps and/or system modules may be suitably replaced, reordered, removed and additional steps and/or system modules may be inserted depending upon the needs of the particular application, and that the systems of the foregoing embodiments may be implemented using any of a wide variety of suitable processes and system modules, and is not limited to any particular computer hardware, software, middleware, firmware, microcode and the like. For any method steps described in the present application that can be carried out on a computing machine, a typical computer system can, when appropriately configured or designed, serve as a computer system in which those aspects of the invention may be embodied.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied. Thus, the present invention is not limited to any particular tangible means of implementation.

It will be further apparent to those skilled in the art that at least a portion of the novel method steps and/or system components of the present invention may be practiced and/or located in location(s) possibly outside the jurisdiction of the United States of America (USA), whereby it will be accordingly readily recognized that at least a subset of the novel method steps and/or system components in the foregoing embodiments must be practiced within the jurisdiction of the USA for the benefit of an entity therein or to achieve an object of the present invention. Thus, some alternate embodiments of the present invention may be configured to comprise a smaller subset of the foregoing means for and/or steps described that the applications designer will selectively decide, depending upon the practical considerations of the particular implementation, to carry out and/or locate within the jurisdiction of the USA. For example, any of the foregoing described method steps and/or system components which may be performed remotely over a network (e.g., without limitation, a remotely located server) may be performed and/or located outside of the jurisdiction of the USA while the remaining method steps and/or system components (e.g., without limitation, a locally located client) of the forgoing embodiments are typically required to be located/performed in the USA for practical considerations. In client-server architectures, a remotely located server typically generates and transmits required information to a US based client, for use according to the teachings of the present invention. Depending upon the needs of the particular application, it will be readily apparent to those skilled in the art, in light of the teachings of the present invention, which aspects of the present invention can or should be located locally and which can or should be located remotely. Thus, for any claims construction of the following claim limitations that are construed under 35 USC § 112 (6) it is intended that the corresponding means for and/or steps for carrying out the claimed function are the ones that are locally implemented within the jurisdiction of the USA, while the remaining aspect(s) performed or located remotely outside the USA are not intended to be construed under 35 USC § 112 (6).

It is noted that according to USA law, all claims must be set forth as a coherent, cooperating set of limitations that work in functional combination to achieve a useful result as a whole. Accordingly, for any claim having functional limitations interpreted under 35 USC § 112 (6) where the embodiment in question is implemented as a client-server system with a remote server located outside of the USA, each such recited function is intended to mean the function of combining, in a logical manner, the information of that claim limitation with at least one other limitation of the claim. For example, in client-server systems where certain information claimed under 35 USC § 112 (6) is/(are) dependent on one or more remote servers located outside the USA, it is intended that each such recited function under 35 USC § 112 (6) is to be interpreted as the function of the local system receiving the remotely generated information required by a locally implemented claim limitation, wherein the structures and or steps which enable, and breath life into the expression of such functions claimed under 35 USC § 112 (6) are the corresponding steps and/or means located within the jurisdiction of the USA that receive and deliver that information to the client (e.g., without limitation, client-side processing and transmission networks in the USA). When this application is prosecuted or patented under a jurisdiction other than the USA, then "USA" in the foregoing should be replaced with the pertinent country or countries or legal organization(s) having enforceable patent infringement jurisdiction over the present application, and "35 USC § 112 (6)" should be replaced with the closest corresponding statute in the patent laws of such pertinent country or countries or legal organization(s).

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC § 112 (1), all claims must be supported by sufficient disclosure in the present patent specification, and any material known to those skilled in the art need not be explicitly disclosed. However, 35 USC § 112 (6) requires that structures corresponding to functional limitations interpreted under 35 USC § 112 (6) must be explicitly disclosed in the patent specification. Moreover, the USPTO's Examination policy of initially treating and searching prior art under the broadest interpretation of a "mean for" claim limitation implies that the broadest initial search on 112(6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC § 112 (6) when such corresponding structures are not explicitly disclosed in the foregoing patent specification. Therefore, for any invention element(s)/structure(s) corresponding to functional claim limitation(s), in the below claims interpreted under 35 USC § 112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC § 112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3$^{rd}$ parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC § 112 (6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC § 112 (6). Applicant(s) note that all the identified documents above which are incorporated by reference to satisfy 35 USC § 112 (6) necessarily have a filing and/or publication date prior to that of the instant application, and thus are valid prior documents to incorporated by reference in the instant application.

Having fully described at least one embodiment of the present invention, other equivalent or alternative methods of implementing a platform configured to disengage and stabilize on a pliant surface by pumping a portion of the pliant surface from beneath the platform according to the present invention will be apparent to those skilled in the art. Various aspects of the invention have been described above by way of illustration, and the specific embodiments disclosed are not intended to limit the invention to the particular forms disclosed. The particular implementation of the platform configured to disengage and stabilize on a pliant surface by pumping a portion of the pliant surface from beneath the platform may vary depending upon the particular context or application. By way of example, and not limitation, the platform configured to disengage and stabilize on a pliant surface by pumping a portion of the pliant surface from beneath the platform described in the foregoing were principally directed to a platform that supports a boot for walking on snow or mud, and also pumps debris from the muddy/snow ground surface out from under the platform implementations; however, similar techniques may instead be applied to snow mobile tracks, skis, and sled trailers, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A platform comprising:

a platform housing that is configured to support a load, said platform housing comprises a front end, a rear end, and an interior region, said platform housing further comprises a mounting surface and a traction surface;

an intake aperture, said intake aperture being disposed in said interior region and proximally to said front end of said platform housing, wherein said intake aperture is operable for receiving a portion of a pliable surface;

a discharge channel, said discharge channel is configured to carry a portion of said pliable surface;

a discharge aperture, said discharge aperture being disposed in said interior region and proximally to said rear end of said platform housing, said discharge aperture being in communication with said intake aperture through said discharge channel, wherein said discharge aperture is operable for discharging at least a portion of the pliable surface propelled into said intake aperture;

a pump portion, said pump portion being arranged along a longitudinal axis of said platform housing, said pump portion comprises a piston that is configured to linearly reciprocate along said discharge channel for creating a vacuum between said intake aperture and said discharge aperture; and a drive portion, said drive portion being disposed to operatively connect to said pump portion, said drive portion being configured to actuate said pump portion, said drive portion further being configured to be powered, at least partially, from a displacement by said platform housing, wherein said linearly reciprocating movement of said pump portion is greater than said displacement of said platform housing.

2. The platform of claim 1 in which, said platform housing comprises a substantially elongated shape.

3. The platform of claim 2 in which, said mounting surface comprises a load fastening portion.

4. The platform of claim 3 wherein, said load fastening portion at least partially fastens the load to said mounting surface.

5. The platform of claim 4 in which, said load comprises a boot.

6. The platform of claim 5 in which, traction surface is configured to engage a pliant surface.

7. The platform of claim 6 in which, said pliant surface comprises a muddy ground surface.

8. The platform of claim 7 wherein, said pump portion is disposed in said interior region, proximal to said traction surface.

9. The platform of claim 8 in which, said piston comprises a hydraulic piston.

10. The platform of claim 9 in which, said drive portion comprises a main sprocket.

11. The platform of claim 10 in which, said drive portion comprises a secondary sprocket.

12. The platform of claim 11 in which, said drive portion comprises a cable.

13. The platform of claim 12 in which, said cable comprises a chain.

14. The platform of claim 13 in which, said cable is configured to rotatably engage said main sprocket and said secondary sprocket.

15. The platform of claim 14 wherein, said rotary motion of said cable on the sprockets is configured to convert to said linear reciprocating motion of said piston through a linear actuator.

16. The platform of claim 15 in which, said drive portion comprises a drive housing, said drive housing being configured to at least partially cover said main sprocket and said cable.

17. The platform of claim 16 in which, said displacement motion of said platform comprises a walking gait.

18. A platform consisting essentially of:

means for supporting a load, wherein said load comprises at least one of, a foot, a boot, a shoe, and a snow track;

means for mounting said load on said support means;

means for engaging a pliant surface with said support means;

means for generating momentum forces;

means for intaking a portion of said pliant surface through said support means;

means for propelling portions of the pliant surface through said intaking means;

means for actuating said propelling means in response to said momentum forces generating means;

means for discharging said portion of said pliant surface through said support means; and means for extracting said support means from said pliant surface.

19. A platform consisting of:

a platform housing, said platform housing comprising a substantially elongated shape, said platform housing being defined by a front end, a rear end, and an interior region, said platform housing further being defined by a mounting surface, said mounting surface comprising a load fastening portion, said platform housing further comprising a traction surface; an intake aperture, said intake aperture being disposed in said interior region and proximally to said front end of said platform housing;

a discharge aperture, said discharge aperture being disposed in said interior region and proximally to said rear end of said platform housing, said discharge aperture being in communication with said intake aperture through a discharge channel;

a pump portion, said pump portion being arranged along a longitudinal axis of said platform housing, said pump portion being configured to linearly reciprocate along said discharge channel for creating a vacuum between said intake aperture and said discharge aperture, said pump portion comprising a piston; and a drive portion, said drive portion being disposed to operatively connect to said pump portion, said drive portion being configured to actuate said pump portion, said drive portion further being configured to be powered, at least partially, from a displacement by said platform housing, said drive portion comprising a main sprocket, a secondary sprocket, and a cable, said cable being configured to rotatably engage said piston.

* * * * *